United States Patent [19]

Woebbeking

[11] 3,951,055

[45] Apr. 20, 1976

[54] EGG BLOWER

[75] Inventor: Raymond Woebbeking, Conrath, Wis.

[73] Assignee: The Raymond Lee Organization, Inc., New York, N.Y.

[22] Filed: Feb. 11, 1975

[21] Appl. No.: 549,007

[52] U.S. Cl. ..... 99/568

[51] Int. Cl.[2] ..... A47J 43/14

[58] Field of Search ..... 99/516, 568, 569, 579, 99/580

[56] References Cited

UNITED STATES PATENTS

| | | | |
|---|---|---|---|
| 2,445,490 | 7/1948 | Meade | 99/568 |
| 2,466,310 | 4/1949 | Gaylor | 99/516 |
| 2,962,067 | 11/1960 | Mesojedec | 99/568 |

*Primary Examiner*—Richard E. Aegerter
*Assistant Examiner*—Richard R. Stearns
*Attorney, Agent, or Firm*—Howard I. Podell

[57] ABSTRACT

A device for blowing the contents of a boiled egg out of the egg shell, preparatory to serving. The device is in the form of a frame mounted on legs with a bellows unit attached to a lever arm mounted on the frame. The egg is placed on a shelf mounted to the frame below the bellows unit, after an opening has been made in opposed ends of the egg with the egg fitted over a beveled opening in the shelf. The lever arm then is rotated to bring the opening of the bellows over the egg and in airtight engagement with the upper surface of the shelf, with further rotation of the lever serving to force air out of the bellows against the contents of the egg shell forcing the contents out of the underside of the shell into a container mounted between the legs of the device, under the shelf.

2 Claims, 2 Drawing Figures

EGG BLOWER

SUMMARY OF THE INVENTION

My invention is a device for blowing the contents of a boiled egg out of the egg shell, preparatory to serving. The device is in the form of a frame mounted on legs with a bellows unit attached to a lever arm mounted on the frame. The egg is placed on a shelf mounted to the frame below the bellows unit, after an opening has been made in opposed ends of the egg with the egg fitted over a beveled opening in the shelf. The lever arm then is rotated to bring the opening of the bellows over the egg and in airtight engagement with the upper surface of the shelf, with further rotation of the lever serving to force air out of the bellows against the contents of the egg shell forcing the contents out of the underside of the shell into a container mounted between the legs of the device, under the shelf.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
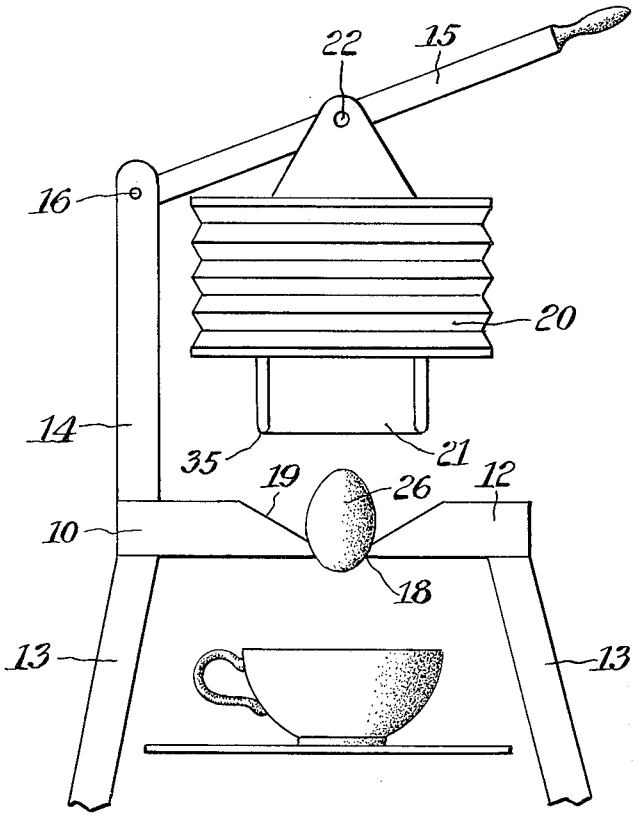
FIG. 1 is a side view of the invention preparatory to use.
Figure 2:
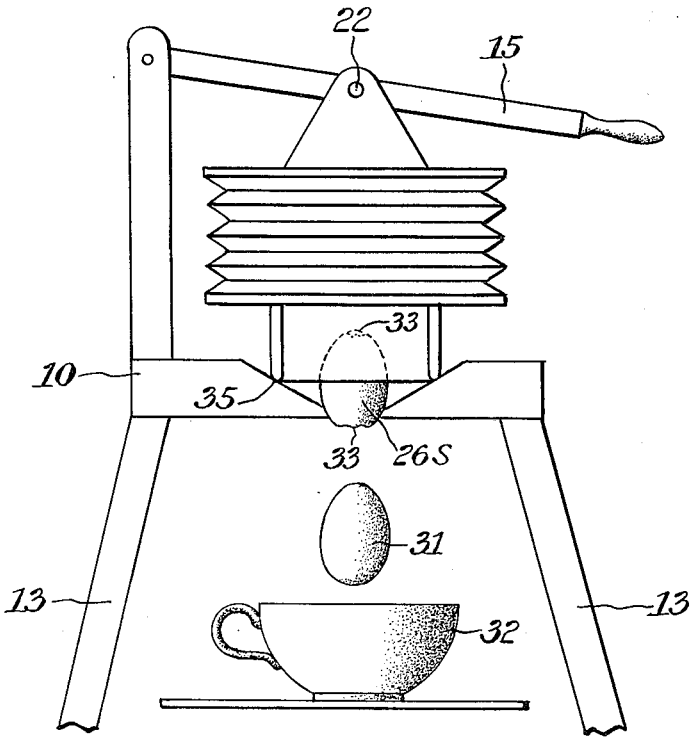
FIG. 2 is a side view of the invention after it has been utilized.

Turning now descriptively to the drawings, in which similar reference characters denote similar elements throughout the several views, FIGS. 1–2 illustrate the device 10 formed of a shelf 12 mounted on a plurality of legs 13, with a vertical member 14 fastened to an end of the shelf, and with a lever arm 15 pivotably mounted by a pin 16 to the top of the vertical member 14 above the shelf 12. A through hole 18 is formed in the central section of the shelf, with a beveled surface 19 leading from the upper edge of hole 18 to the top surface of the shelf 12.

A flexible tubular bellows unit 20, open only at its bottom end 21 is hung from the lever arm 15 by a pin 22, with the bottom end 21 of the bellows formed as a cylinder of a size to enclose an egg 26 resting in the beveled surface 19 and hole 18 of the shelf 12.

In use, the shell of egg 26 is first cracked to form an opening 33 at each end of the egg shell and then placed in the beveled surface 19 over the shell opening 18 with one hole 33 oriented in the shelf opening 18. The lever arm 15 is then manually rotated downwards to bring bellows 20 over the egg 26 and to bring the bottom edge 35 in airtight engagement with the stop surface of the beveled section 19 of the shelf 12. Further downward rotation of the lever arm 15 causes a build-up of pressure against the contents of the egg 26 to cause the contents 31 to eject through the bottom hole 33 in the egg shell into a container 32 placed between the legs 13 of the device, under the shelf 12. The empty egg shell 26S remains undisturbed on the shelf.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by letters patent of the United States is:

1. A device for ejecting the contents of an egg out of an egg shell, comprising a shelf formed with an opening of a size smaller than the size of an egg, on which an egg may be placed a bellows formed of flexible tubing, closed at a first end and formed with a mouth opening at a second end, said mouth opening bordered by a rim of a size to freely fit about an egg, lever means joined to the shelf to move the bellows in the axial direction of the bellows to or from the opening of the shelf, said lever means adaptable to compress the rim of the mouth opening of the bellows against the shelf and about an egg located on the shelf opening, in a first position of the lever means, with further movement of the lever means from said first position to a second position, acting to compress the tubing of the bellows and compress the air inside the bellows so as to blow the contents of the egg through the opening in the shelf.

2. The combination as recited in claim 1 in which the top surface of the shelf is formed with a bevelled recess about the shelf opening.

* * * * *